US008422705B2

(12) United States Patent
Kilsgaard

(10) Patent No.: US 8,422,705 B2
(45) Date of Patent: Apr. 16, 2013

(54) APPARATUS AND METHOD FOR OPERATING A HEARING AID

(75) Inventor: Soren Kilsgaard, Ballerup (DK)

(73) Assignee: Widex A/S, Lynge (DK)

( * ) Notice: Subject to any disclaimer, the term of this patent is extended or adjusted under 35 U.S.C. 154(b) by 1521 days.

(21) Appl. No.: 11/778,364

(22) Filed: Jul. 16, 2007

(65) Prior Publication Data

US 2007/0269065 A1 Nov. 22, 2007

Related U.S. Application Data

(63) Continuation-in-part of application No. PCT/DK2005/000026, filed on Jan. 17, 2005.

(51) Int. Cl.
*H04R 25/00* (2006.01)

(52) U.S. Cl.
USPC ..... 381/315; 381/312; 381/314

(58) Field of Classification Search ..... None
See application file for complete search history.

(56) References Cited

U.S. PATENT DOCUMENTS

| | | | | |
|---|---|---|---|---|
| 3,108,261 | A * | 10/1963 | Miller | 360/51 |
| 4,456,884 | A * | 6/1984 | Yarborough, Jr. | 341/72 |
| 5,479,522 | A * | 12/1995 | Lindemann et al. | 381/23.1 |
| 5,991,419 | A * | 11/1999 | Brander | 381/312 |
| 6,707,342 | B1 * | 3/2004 | Zachan et al. | 331/2 |
| 6,738,485 | B1 * | 5/2004 | Boesen | 381/312 |
| 6,842,647 | B1 | 1/2005 | Griffith | |
| 7,199,671 | B2 * | 4/2007 | Wissell et al. | 331/2 |
| 7,421,085 | B2 * | 9/2008 | Husung et al. | 381/312 |
| 7,447,325 | B2 * | 11/2008 | Bren et al. | 381/331 |
| 7,715,576 | B2 | 5/2010 | Ribic | |
| 2003/0072325 | A1 | 4/2003 | Brandli | |
| 2003/0142838 | A1 * | 7/2003 | Brennan et al. | 381/98 |
| 2003/0235319 | A1 * | 12/2003 | Rass | 381/312 |

(Continued)

FOREIGN PATENT DOCUMENTS

| | | | |
|---|---|---|---|
| EP | 1 250 026 | A | 10/2002 |
| JP | 8274752 | A | 10/1996 |

(Continued)

OTHER PUBLICATIONS

Hyung Chul Park, "Partial Matched Filter for Low Power and Fast Code Acquisition of DSSS-CPFSK Signals", Published in: Journal of Semiconductor Technology and Science, vol. 4, No. 3, Sep. 2004, pp. 204-209.*

(Continued)

*Primary Examiner* — Duc Nguyen
*Assistant Examiner* — Taunya McCarty
(74) *Attorney, Agent, or Firm* — Sughrue Mion, PLLC

(57) ABSTRACT

A programmable hearing aid including means for receiving and transmitting data wirelessly from and to a portable module being in proximity to said hearing aid. Said portable module has means for transmitting audio signals, fitting data or special instructions to the hearing aid processor and including means for receiving data transmitted from said hearing aid, including data representing a monitoring of real-time signal processing parameters in the hearing aid. A preferred embodiment of the hearing aid/portable module combination utilizes Miller-coded direct sequence spread-spectrum radio signal transmitters and receivers for transmitting and receiving data between the heading aid and the portable module. This enables remote controlling or monitoring of, transmitting audio to, or programming of a hearing aid without the need for external connectors.

21 Claims, 5 Drawing Sheets

U.S. PATENT DOCUMENTS

| | | | | |
|---|---|---|---|---|
| 2004/0037442 | A1 | 2/2004 | Nielsen et al. | |
| 2005/0008175 | A1 | 1/2005 | Hagen | |
| 2005/0089183 | A1* | 4/2005 | Niederdrank et al. | 381/312 |
| 2006/0145853 | A1* | 7/2006 | Richards et al. | 340/572.1 |

FOREIGN PATENT DOCUMENTS

| | | | |
|---|---|---|---|
| JP | 11331946 | A | 11/1999 |
| JP | 2004504786 | T | 2/2004 |
| JP | 2004527183 | T | 9/2004 |
| WO | 02/07479 | A1 | 1/2002 |
| WO | 02/089520 | A2 | 11/2002 |

OTHER PUBLICATIONS

Japanese Office Action 2007-550674 Oct. 19 2010 with English translation.

* cited by examiner

APPARATUS AND METHOD FOR OPERATING A HEARING AID

RELATED APPLICATIONS

The present application is a continuation-in-part of application No. PCT/DK2005/000026, filed on Jan. 17, 2005, in Denmark and published as WO-A1-2006/074655, the contents of which are incorporated hereinto by reference.

BACKGROUND OF THE INVENTION

1. Field of the Invention

The present invention relates to hearing aids and to methods of operating hearing aids. The invention, more specifically relates to hearing aid systems comprising hearing aids, wireless transceivers and remote controls.

2. The Prior Art

Hearing aids capable of being operated by remote controls are known. Remote controls have been used primarily for selecting among different listening programmes stored in the hearing aids and for individual adjustment of the output levels of the hearing aids. The data bandwidth of the communications channels available in existing remote control systems for use in hearing aids is comparatively small and mainly used for simple commands like "adjust output level up one notch" or "change to program 2", these command types taking up but a small number of bits of information. Existing wireless communications channels for the remote control of hearing aids in use today are usually one-way channels, i.e. it is not possible to transmit information from the hearing aid via the communications channel.

Recent developments in hearing aid signal processors encompass a multitude of different parameters and settings stored in non-volatile memory circuits in the hearing aid, each setting having a specific relation to the performance of the hearing aid, e.g. gain and compression levels in different frequency bands. The values of these parameters and settings will usually be decided and stored in the hearing aid during a fitting session with the user and a fitter. The effect of changing one or more parameters in the hearing aid may, to some extent, be monitored by the fitter through simulation in computer software, and, in some systems, monitored by reading out the parameters from the hearing aid in real-time, as described in the following.

An industry standard programming interface is the NOAH-Link® interface, manufactured by Madsen Electronics, Taastrup, Denmark. This programming interface comprises a transponder unit worn in a string around a hearing aid user's neck and connected, during use, to one or two hearing aids via cables and connectors. The transponder unit is capable of transmitting or receiving digital programming signals from a personal computer equipped with a similar transponder and running suitable software for the purpose of programming the hearing aid.

The transponders in the programming device and the personal computer preferably utilize the industry standard Bluetooth® wireless networking interface for communication, and the personal computer runs a version of the industry standard Compass® hearing aid fitting software. During use, a fitter of hearing aids may use this programming interface to program a prescription frequency response into the hearing aids of the user as decided, based on a hearing test, and according to the user's preferences. Data regarding the condition, programming, type, and serial number etc. of the hearing aids to be programmed may also be read out by the system for display in the computer. Although the link between the transponder and the personal computer is wireless, the system requires galvanic connection between the transponder of the programming device and the hearing aid circuitry.

However, connector sockets in hearing aids are complicated in design and manufacture, a potential source of error, and add significantly to the bulk of the hearing aids. The fitting of hearing aids with cables is a significant complication for the fitter.

U.S. Pat. No. 5,615,229 describes a magnetically coupled short-range communication system for transmitting audio signals between a magnetic transmission element and a magnetic receiving element in a hearing aid. The audio signals are transmitted as a time variant modulated, pulse coded data stream. This is a simplex system, and the magnetic receiving element in the hearing aid appears to be power-intensive, thus putting a great strain on the hearing aid battery.

WO 98 48526 devises a magnetic-induction time-multiplexed two-way short-range communications system for transmission and reception of signals between a telephone base unit and a portable headset in close proximity to said base unit. It has duplex capabilities and an adequate bandwidth, but the size of the receiver and transmitter in this system prohibits its use in hearing aid systems.

US 2004/0037442 describes a wireless binaural hearing aid system utilizing direct sequence spread spectrum technology to synchronize operation between individual hearing prostheses. This system enables two hearing aids to communicate wirelessly with each other for the purpose of synchronizing the sampling of the sounds picked up by the hearing aid microphones. A remote control is not involved in this system.

U.S. Pat. No. 5,390,254 discloses a hearing aid adapted for control by hand-held radio-controlled volume and tone controls and utilizing a radio link to enable enhanced real-time signal processing of the incoming sound via a remote processor. The wireless system utilized in this hearing aid is essentially based on analog processing, and although such a system could be made to function in practice it would be very cumbersome to use due to the size and power consumption of the components involved. However, no practical suggestions as to how such a wireless system might be implemented in practice are devised in U.S. Pat. No. 5,390,254, and no reference to any supporting literature in this respect are made.

EP 1 445 982 A1 describes an apparatus and method for mutual wireless communication between one or two hearing aids and a remote control unit for the purpose of controlling program selection and adjusting output volume. The communication is controlled by assigning different priorities to the hearing aids and the remote control unit and making each unit transmit in its own time slot according to the assigned priority. Apparently, no means to communicate from the remote control unit by other means than those provided for communication to the hearing aids, are provided.

EP 1 460 769 A1 discloses an electronic module and a mobile transceiver comprising several receivers for receiving electrical or electromagnetic signals carrying audio signals and a radio transmitter for transmitting radio signals carrying audio signals. The mobile transceiver comprises a prioritising module and a transmitter for transmitting audio received by one of the receivers to a hearing aid comprising a receiver. The actual transmission scheme used by the mobile transceiver is not disclosed, and no means for transmitting signals from the hearing aid to the mobile transceiver is disclosed.

SUMMARY OF THE INVENTION

It is an object of the invention to provide a hearing aid system with wireless communication between one or two hearing aids and a portable device that has sufficient bandwidth for transmitting digital audio to the hearing aids.

It is a further object of the invention to provide a hearing aid system that has a capability for conveying information from the hearing aids to other external equipment.

It is still a further object of the invention to provide a hearing aid system with wireless communication between a hearing aid and an external unit that operates with a very low power consumption.

It is another object of the invention to provide a hearing aid system with wireless communication between two hearing aids at high capacity yet at low power consumption.

It is another object of the invention to provide a broadband, bidirectional, wireless, digital communications channel to be used for communicating between a remote control and one or two hearing aids during programming.

It is an additional object of the invention to provide a hearing aid with the capability of wireless transmission at high capacity yet operating at very low power consumption.

According to the invention, in a first aspect, this object is fulfilled by a hearing aid system comprising a portable module having a first transceiver for transmitting and receiving electromagnetic signals, a Miller encoder for generating data for transmission, a Miller decoder for decoding received signals and means for producing output data based on the decoded signals, at least one hearing aid having a second transceiver for transmitting and receiving electromagnetic signals, a Miller decoder for decoding received signals, means for storing programming information derived from the decoded signals, means for producing an output signal based on the decoded signals, and a Miller encoder for generating data for transmission, the first and the second transceiver being adapted for transmitting and receiving Miller-encoded signals modulated according to a direct sequence spread spectrum (DSSS) scheme.

This hearing aid system uses a digital wireless transmitter circuit. Such a transmitter circuit is preferably physically small in size, small enough to fit into a completely-in-the-canal (CIC) hearing aid. The power consumption of such a transmitter, when used in a hearing aid, has to be very low. The maximum power consumption of a transmitter of this kind is comparable with that of a standard hearing aid output transducer.

A system of this kind should have a spatial range of at least 1 meter, a high reliability, preferably with error-correction, being adequate for avoiding deadlock situations or loss of information due to simultaneous transmission or interference from similar systems nearby, a bandwidth wide enough for transmitting (compressed) audio signals and other real-time signals between a hearing aid and a portable device, and an acceptably low power consumption, especially with respect to the transceiver in the hearing aid.

Using the transmitter circuit, a wireless, digital communications channel is made available from one or more hearing aids to a portable module, all incorporating an embodiment of the transmitter circuit for one or more of the following purposes: transferring audio signals from the hearing aid to the portable module for the purpose of monitoring the signal processing in the hearing aid, transferring real-time parameters from the hearing aid to the portable module for the purpose of logging, or transferring digital real-time signal processing parameters from the hearing aid to the portable module for the purpose of monitoring the signal processor in the hearing aid during use. The portable module may then relay the digital signals from the hearing aids to e.g. a computer or similar means for picking up the relayed signals for analysis and further processing.

Such a transmitter may preferably be manufactured as an embeddable, monolithic, electronic module for building into a hearing aid acting as a host system for the transmitter. Spread spectrum transmitter of this kind have several benefits over similar devices known in the art. They may be made physically very small, thus fitting well within the confined space of a behind-the-ear or an in-the-ear hearing aid housing, they have a noise-like frequency spectrum footprint, thus causing little or no interference problems, and they consume very little power, making this transmission technology very well suited for hearing aid applications where power consumption and battery life are at a premium.

A spread-spectrum transmitter is characterised by the fact that it transmits signals, not on a single carrier frequency but instead a range of frequencies. A frequency-hopping spread-spectrum transmitter transmits on a set of discrete frequencies within this range, and a direct-sequence spread-spectrum transmitter transmits on practically every frequency within the range, having a noise-like frequency spectrum footprint. This allows for excellent immunity to noise, and thus makes the power requirements for a desired transmission range significantly smaller.

A Miller-coding spread-spectrum transceiver has an almost rectangular frequency spectrum distribution footprint as opposed to a regular spread-spectrum transceiver having a frequency spectrum distribution footprint having more rounded ends. This ensures that the frequencies at the ends of the utilized frequency range of the transceiver have a power level that is comparable to the frequencies near the center of the utilized frequency range. A Miller-coding transceiver may be easily implemented in current silicon-chip technology.

Signals representing e.g. programming data, remote control signals, real-time audio signals, condition readout requests or identity requests may be transmitted from the portable module to the hearing aid, and signals representing e.g. acknowledge signals, condition readouts, real-time signal processing readouts or identity signals may be transmitted from the hearing aid to the portable module.

According to a preferred embodiment of the hearing aid system the first transceiver comprises a master section comprising an output stage, a frequency reference crystal, and an oscillator controlled by said frequency reference crystal, said master section being electrically detachable from the transceiver circuitry.

This preferred embodiment enables signals of arbitrary origin to be transmitted from the portable module to one or more hearing aids. This feature may, for instance, be used for controlling the hearing aid with the portable module, programming the hearing aid via the portable module, transferring digital audio signals to the hearing aid from the portable module, transferring programming data to the hearing aid from the portable module, or transmitting data wirelessly from an external source, such as a personal computer or similar appliance, wirelessly to the hearing aid via the portable module.

The transmitter/receiver combination present in the hearing aid and the portable module renders the hearing aid system capable of mutual, bidirectional communication between the hearing aid and external equipment. This transmitter/receiver combination may preferably be integrated into a single, monolithic unit embeddable into a hearing aid or a portable module. In this application, this combination is hereinafter referred to as a transceiver.

The transceiver may be put into one of three states or modes of operation, denoted the "sleep" mode, the "receive" mode, and the "transmit" mode, respectively. In the "sleep" mode, the transceiver is idle, i.e. doing nothing but waiting for a signal from the host system ordering it to change its state. In this state, the transceiver circuitry draws very little current from its host system. In the "receive" mode, the receiver of the transceiver is activated for a predetermined period and "listening" for transmissions from another transceiver. Whenever a transmission is detected, the receiver decodes the message as it is received and presents the decoded, received message to the host system as a binary bit stream. In the "transmit" mode, the transmitter of the transceiver is activated by the host system whenever a message is ready for transmission.

The message to be transmitted, which will be presented by the host system as a binary bit stream, is fed to the signal input of the transceiver and transmitted by the transmitter of the transceiver for the purpose of being received by a receiver located within the transmission range and being capable of recognizing the transmitted message. In a preferred embodiment, the transmitter of the transceiver has an effective range of approximately 1 meter.

The "receive" mode may be initiated by e.g. a watchdog timer preprogrammed with a predetermined listening period and interval, or triggered by the conclusion of a transmission. If a message—or a part of a message—is received during a "reception" period, the receiver is left open until an acknowledge signal from the host is sent back to the first transceiver, or until a predetermined time period has elapsed. During this period, a message transmitted by a nearby second transceiver may be picked up, detected and decoded by the receiver of the first transceiver and transferred to the hearing aid processor as a binary bit stream. If, however, no message is sent during the predetermined time period, the transceiver reenters the "sleep" mode until another "receive" mode signal is produced by the hearing aid processor.

Transmission of messages from the hearing aid may be initiated by transmitting a dedicated transmission request message from the transceiver of the portable module during a "reception" period. When the hearing aid receives the dedicated transmission request, the hearing aid processor prepares a message for transmission and transmits it using the "transmit" mode of the transceiver in the hearing aid immediately after the end of the "reception" period. The transmitted messages may comprise, but are not limited to, acknowledge messages, identification messages, parameter readout messages, signal processing status messages, logging messages, and audio streaming block messages. These messages may then be picked up and relayed by the portable module to e.g. a personal computer, a fitting system or an associated remote control unit.

According to a preferred embodiment of the hearing aid system, the transmitter comprises a master section comprising an output stage, a frequency reference crystal, and an oscillator controlled by said reference crystal, said master section being electrically detachable from the transmitter circuitry. In this embodiment, the transmitter is preferably placed in the portable module.

The transmitter also comprises a slave section comprising a selectable output stage. The transceiver uses the phase-locked loop for locking its reception frequency onto the transmitting frequency of the oscillator in the transceiver acting as master and for monitoring this frequency after a master transmission has terminated, said reception frequency being used as a transmission frequency at which the transceiver acting as slave sends an acknowledge signal following a transmission from the transceiver acting as master. In this way the transceiver acting as slave does not need a reference crystal oscillator. Since a crystal reference takes up space and consumes power, dispensing with a crystal is a substantial advantage if the transceiver is to be built into, and used in, even the smallest hearing aids, such as a completely-in-the-canal hearing aid.

The transmitters may initially be in "sleep" mode, and the "reception" mode may be activated at regular intervals in the two hearing aids, respectively, by a watchdog timer constituting part of the hearing aid processor, said hearing aid processor acting as the host system to the transceiver. The "transmit" mode is activated by the hearing aid processor immediately following a reception, and data is then transmitted from the hearing aid to the portable module dependent of the contents of the received and decoded message. The hearing aid processor is capable of transmitting settings, real-time parameters or audio from the hearing aid via the portable module to the computer. If none of these data is required, the hearing aid processor transmits a short acknowledge signal.

The invention, in a second aspect, provides a method of operating a hearing aid system, comprising the steps of: selecting a hearing aid having input means for receiving input data; receiving input data in the hearing aid; decoding the input data; and Miller encoding output data for transmission, characterised by the steps of: transmitting from the hearing aid electromagnetic signals based on the output data and modulated according to a DSSS scheme; receiving the electromagnetic signals modulated according to a DSSS scheme in a portable module; demodulating and Miller decoding the electromagnetic signals, and; producing output data in the portable module based on the Miller decoded signals.

This enables the hearing aid to be operated from e.g. a remote control associated with the portable module and having means for recalling stored programs in the hearing aid, adjusting the volume in the hearing aid, or transmitting audio signals to the hearing aid. The audio signals may, for instance, originate from a telecoil loop system, and the telecoil be disposed in the portable module instead of being placed in the hearing aid. Given that the transceiver circuitry takes up less space than the average telecoil, a telecoil functionality may be built into even completely-in-the-canal hearing aids where space considerations until now have been a prohibitive factor.

The invention, in a third aspect, provides a method of programming a hearing aid comprising the steps of determining a hearing loss to be compensated by a hearing aid; selecting a hearing aid adapted for compensating a hearing loss according to program settings stored in the hearing aid and for receiving and transmitting electromagnetic signals modulated according to a DSSS scheme; using a computer to generate program settings for the hearing aid suitable for compensating the hearing loss; transmitting the program settings from the computer to an portable module; transmitting the program settings from the portable module to the hearing aid by electromagnetic transmission modulated according to a DSSS scheme; receiving the electromagnetic transmission in the hearing aid; decoding and storing the received program settings in the hearing aid; transmitting from the hearing aid electromagnetic signals based on data from the hearing aid modulated according to a DSSS scheme; receiving and decoding in the portable module electromagnetic signals modulated according to a DSSS scheme in order to produce a decoded output; and transmitting data based on the decoded output from the portable module to the computer.

In this way, hearing aids may be programmed without being galvanically connected to any external hardware, thus eliminating the need for wires and connectors- and thus the problems of wear and corrosion associated with this type of connection.

Further features and advantages of the hearing aid system according to the invention will become evident from the dependent claims.

BRIEF DESCRIPTION OF THE DRAWINGS

The invention will now be described in further detail in conjunction with several embodiments and the accompanying drawings, in which.

DETAILED DESCRIPTION OF THE INVENTION

Figure 1:
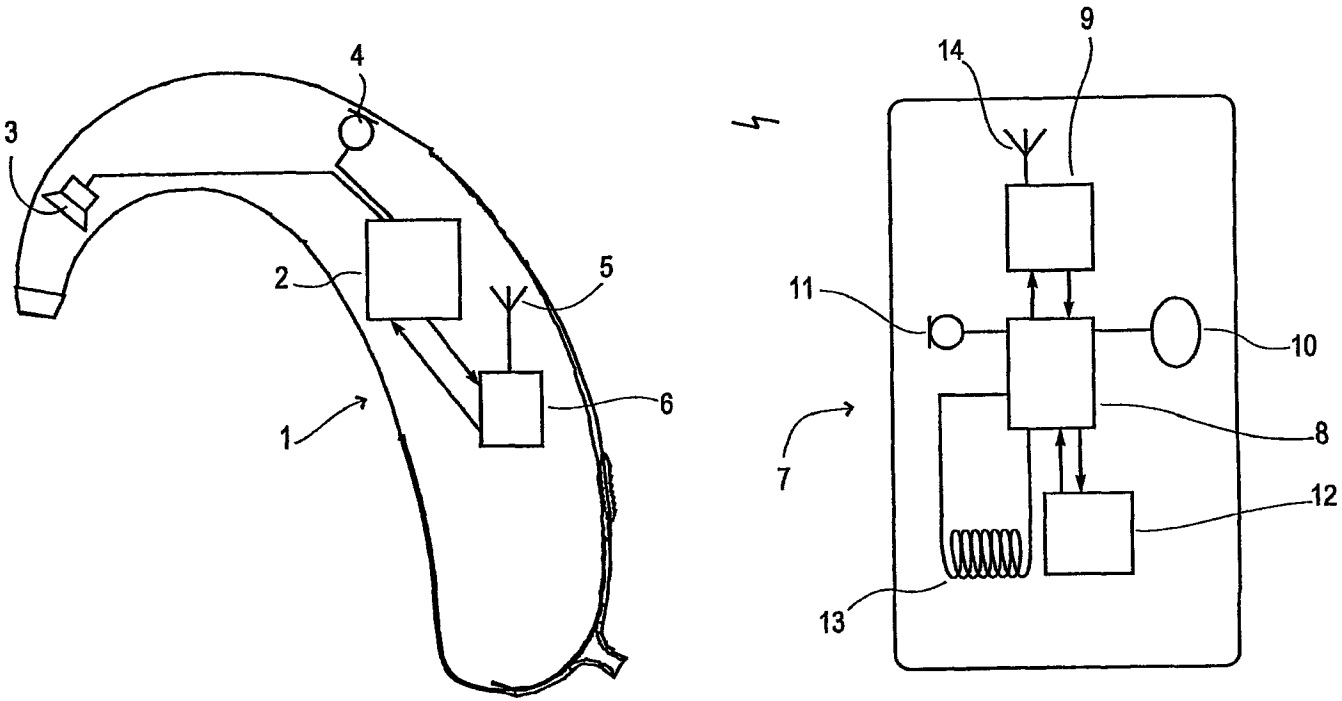
FIG. 1 shows a preferred embodiment of a hearing aid and a portable module.

FIG. 1 shows a hearing aid 1 placed in proximity of a portable module 7 according to an embodiment of the invention. The hearing aid 1 comprises a hearing aid processor 2 connected to a microphone 4 and a first transceiver 6. The hearing aid processor 2 is further connected to an output transducer 3. The first transceiver 6 is connected to a first antenna 5. The portable module 7 comprises a second processor 8 connected to a second transceiver 9, an auxiliary interface 10, a second microphone 11, an input/output interface 12, a telecoil 13 and a second antenna 14.

The second processor 8 in the portable module 7 is capable of communicating wirelessly with the hearing aid 1 via the second transceiver 9, and capable of communicating wirelessly with a computer or the like (not shown) via the auxiliary interface 10, which may also be wireless.

The first antenna 5 and the first transceiver 6 of the hearing aid 1 enables reception of digital data signals representing messages concerning e.g. program or volume control changes while the hearing aid 1 is in use. The available bandwidth of the receiver of the first transceiver 6 is sufficiently wide to convey digitally represented audio signals to the hearing aid processor 2 of the hearing aid 1 for the purpose of acoustic reproduction by the output transducer 3.

The second processor 8 of the portable module 7 is capable of generating digital data signals for transmission to the hearing aid 1 regarding e.g. program changes or volume control information. The second transceiver 9 and the second antenna 14 transmit digital data signals to the hearing aid 1. The audio signals may originate from the auxiliary interface 10, the microphone 11, or the telecoil 13. External audio signals may be input to the portable module 7 via the auxiliary interface 10, either wireless or by an external audio source (not shown) connected to the auxiliary interface 10.

Figure 2:
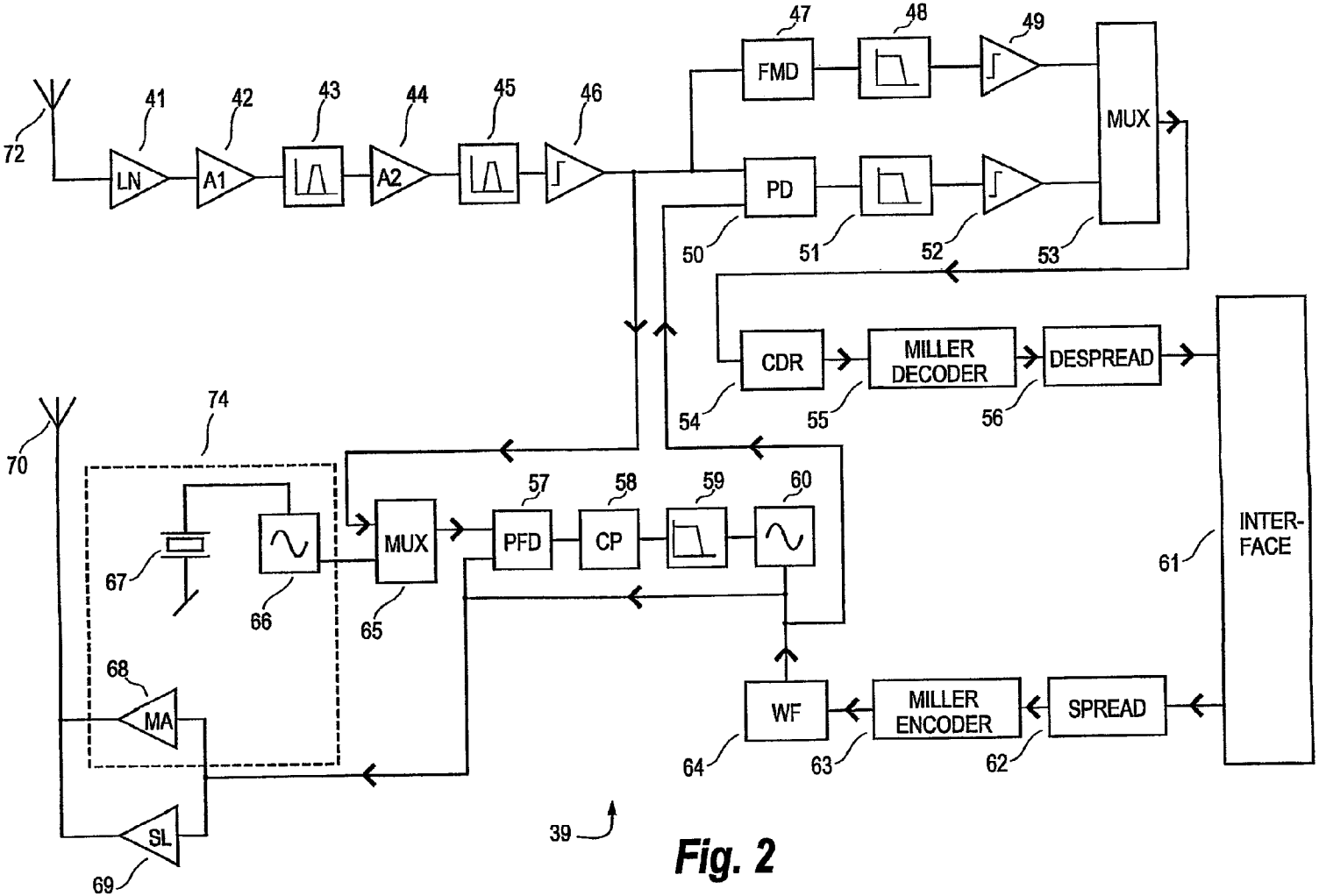
FIG. 2 is a block schematic showing a direct sequence spread spectrum transceiver for use in a hearing aid system according to the invention.

FIG. 2 shows a spread-spectrum digital transceiver 39 according to an embodiment of the invention for use in the hearing aid 1 and the portable module 7 shown in FIG. 1. For simplicity, similar transceiver circuits 39 may be used in both the portable module 7 and the hearing aid 1. The transceiver 39 comprises two main branches for receiving and transmitting signals, respectively. The transceiver 39 is capable of entering either a reception mode or a transmission mode. An input antenna 72 is provided for reception of wireless signals and an output antenna 70 is provided for the transmission of wireless signals. The input antenna 72 is connected to the input of a low noise input amplifier 41 and the output antenna 70 is connected to the output of a power output amplifier pair 68, 69.

The receiving branch of the transceiver 39 comprises an amplifier and shaper section 41, 42, 43, 44, 45, 46, a demodulation and limiting section 47, 48, 49, 50, 51, 52, 53, and a digital input section 54, 55, 56. The amplifier and shaper section comprises a low noise input amplifier 41, a first preamplifier 42, a first band pass filter 43, a second preamplifier 44, a second band pass filter 45 and a first limiter 46. The demodulating and limiting section comprise an FM demodulator 47, a first low pass filter 48, a second limiter 49, a phase comparator 50, a second low pass filter 51, a third limiter 52 and a first multiplexer 53. The digital input section comprises a clock data recovery block 54, a Miller decoder 55 and a first correlator 56. The output of the digital input section 54, 55, 56 is connected to the input of a CPU interface 61.

The transmitting branch comprises a digital output section 62, 63, 64, an oscillator and phase-lock section 57, 58, 59, 60, 65, a crystal-controlled master oscillator section 66, 67, and a power amplifier output section 68, 69, 70. The digital output section comprises a correlator 62, a Miller encoder 63 and a voltage controlled oscillator (VCO) waveform interface block 64. The output of the CPU interface 61 is connected to the input of the correlator 62. The oscillator and phase-lock section comprises a voltage controlled oscillator (VCO) 60, a third low pass filter 59, a charge pump 58, a second multiplexer 65 and a phase/frequency detector 57. The crystal-controlled master oscillator section comprises a master oscillator 66 and a frequency-controlling crystal reference 67. The power amplifier output section comprises the master power amplifier (MA) 68, the slave power amplifier (SL) 69 and the second antenna 70.

When the transceiver 39 is in reception mode, a wireless spread-spectrum signal may be picked up by the antenna 72 and presented to the input of the low noise amplifier 41. The signal is amplified by the low noise amplifier 41 and the amplified signal is then presented to the input of the first preamplifier 42 for further amplification and impedance-matching. The signal from the first preamplifier 42 is band-limited by the first band-pass filter 43, further amplified by the second preamplifier 44, and further band-limited by the second band-pass filter 45. The amplified, band limited signal is then limited by the first limiter 46 before being presented to the demodulating and limiting section 47, 48, 49, 50, 51, 52, 53.

The signal from the limiter 46 acts as the input signal to the FM demodulator 47, the phase comparator 50 and the second multiplexer 65, respectively. In the embodiment shown, the transceiver 39 is capable of transmitting, receiving and processing both Miller-coded FM signals and BPSK signals, and thus two different demodulator means are provided for. Received, Miller-coded FM-signals are demodulated by the FM demodulator 47, filtered by the first low-pass filter 48, and limited by the second limiter 49 before being presented to the first multiplexer 53. Received BPSK signals, on the other hand, are demodulated by the phase comparator 50, filtered by the second low-pass filter 51, and limited by the third limiter 52 before being presented to the input of the first multiplexer 53 for conversion into a digital bit stream.

When the signal leaves the multiplexer 53, it is considered to be a digital signal or bit stream. This digital bit stream enters the clock data recovery block 54 in the digital input section of the transceiver 39 for preconditioning, and the preconditioned bit stream is output to the Miller decoder 55 for decoding. The Miller-decoded bit stream is then despread in the first correlator 56, and the decoded, despread bit stream is fed to the CPU interface 61 for the purpose of being interpreted as digital information by a CPU (not shown) connected to the CPU interface 61.

When the transceiver 39 is in transmission mode, digital information prepared by the CPU (not shown) is processed by the CPU interface 61 and enters the second correlator 62 as a digital bit stream. In the second correlator 62, the bit stream is spread, and the spread bit stream leaves the second correlator 62 and enters the Miller encoder 63. In the Miller encoder 63, the bit stream is converted into a spread-spectrum, Miller-encoded bit stream which is fed to the input of the VCO waveform interface block 64 for providing a control voltage for modulating the VCO 60 based on the bit stream from the Miller encoder 63.

The VCO 60 forms, together with the third low pass filter 59, the charge pump 58 and the phase/frequency detector 57, a phase-locked loop which serves two purposes. It locks the frequency of the receiving branch of the transceiver 39 to the carrier frequency of the transmitter for proper reception of wireless signals, and it determines the transmission frequency of the transmitting branch of the transceiver 39. The output of the VCO 60 is fed to the master power amplifier 68 and the slave power amplifier 69 in the power amplifier output section for final amplification before being transmitted wirelessly by the second antenna 70.

The transmitting branch in the transceiver 39 is capable of using one of two different modulation schemes for transmission, squared Miller-coded frequency modulation (MFM) or binary phase shift keying (BPSK). The two types of modulation are used according to the bandwidth demand by the type of information to be sent, and are selected accordingly by the CPU (not shown) in the portable module or the hearing aid, respectively. BPSK modulation is used for information with a modest bandwidth demand such as program change information, volume change information, and identification messages. MFM is used for information requiring a higher bandwidth such as streaming audio, programming information, or real-time parameter readout from the hearing aid.

In order to keep down costs of manufacture and maintain simplicity, the hearing aid system according to the invention utilizes similar transceivers 39 for both the master transceiver 9 placed in the portable module 7 and the slave transceiver 6 placed in the hearing aid 1 as shown in FIG. 1, but not all blocks in the transceiver 39 are used in both master and slave. When the portable module 7, hereinafter denoted the master, transmits a message, the message is coded and modulated into a wireless signal using one of the two available modulation schemes as described previously, the crystal reference 67 and the master oscillator 66 being used as a frequency reference together with the second multiplexer 65 to control the phase-locked loop section 57, 58, 59, 60 of the transceiver 39 for transmission using the master power amplifier 68 and the second antenna 70.

In order to conserve power, the transceiver 39 in the hearing aid, hereinafter denoted the slave, does not rely on a local reference crystal 67 or local master oscillator 66 for frequency control, but instead uses the VCO 60 as a local oscillator to generate the transmitter carrier frequency and lock onto a received carrier frequency while switching off the respective local oscillator 66, 67. This is decided at the time of manufacture, where the master oscillator 66 and the master output amplifier 68 are disconnected electronically from the rest of the transceiver circuitry, and no crystal reference 67 is provided to the unit. The slave transceiver 39 spends the majority of its operative life in "sleep" mode as discussed earlier, where no transmission or reception by the slave transceiver 39 can take place. At regular intervals, the slave transceiver 39 is put in "reception" mode for a predetermined period by a watchdog circuit or by similar means in order to listen for transmissions from a master transceiver 39.

When a message is received and decoded by the slave transceiver while it is in "receive" mode, the received signal itself is demodulated and decoded in the way described previously. When the demodulated and decoded message is recognized by the CPU in the slave system, any required actions contained in the message are carried out and an acknowledge message is prepared by the CPU.

During preparation, the phase-locked loop 65, 57, 58, 59, 60 is still locked onto the frequency used at reception of the transmission from the master. When the transmission is terminated, the phase-lock 57, 58, 59, 60 is opened, thereby enabling the VCO 60 to run free at approximately the same frequency. This frequency is now used by the slave transceiver 39 for the transmission of the acknowledge message. This eliminates the need for a bulky and power-consuming crystal reference 67 in the slave. The slave power amplifier 69 then transmits the acknowledge message via the second antenna 70. When the acknowledge message has been successfully transmitted, the slave transceiver 39 returns to the "sleep" mode.

As stated previously, the power consumption in the "sleep" mode is very modest, in "reception" mode power consumption is typically about ten times that consumed in "sleep" mode, and in "transmission" mode the power consumption is about twice that in "reception" mode. The transmissions from the slave are usually of relatively short duration and thus do not put any excessive strain on the hearing aid battery supplying the slave transceiver 39.

When the master receives the signal from the slave, the reception follows the same principles as described previously. The transceivers 39 in both the master and the slave are capable of mutual communication using one of the two different modulation schemes selectable by the CPU in either unit based on the type of communication desired and the bandwidth required. The types of communication to be exchanged between the master and the slave may incorporate, but is not limited to, identity handshakes, short instructions, acknowledge signals, programming information, settings, digitally represented real-time audio signals, real-time readout of signal processing parameters, and the like.

When transmitting real-time digital audio, usually some kind of digital compression of the signal is used. The digital representation of the audio signal is collected in a buffer (not shown) of adequate capacity, and the master transceiver 39 then fetches the digital data representing the audio signal in data packets of a size suitable for transmission using the interface 61. The slave transceiver 39 has a similar buffer (not shown) for collecting the received data packets for decoding and decompression of the data packets. Such a buffer configuration ensures sufficient bandwidth overhead for the purpose of transmitting audio without dropouts or data loss, given that the transceivers are within range of one another. Means for handling retransmission of incompletely received or otherwise erroneously transmitted data packets may be provided in the CPU's in both the master and in the slave.

Figure 3:
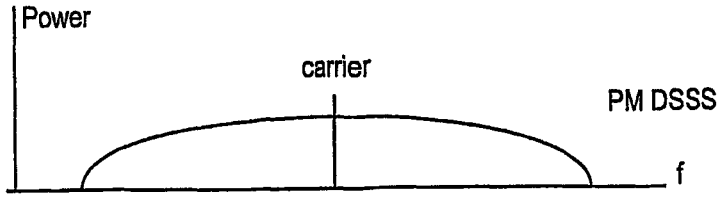
FIG. 3 is a is a graph showing the frequency spectrum of a phase modulated spread spectrum (PM) transceiver.

FIG. 3 is a frequency graph showing the power distribution of a spread spectrum signal. The main carrier frequency is shown in FIG. 3 as a vertical line extending above an area containing the involved frequencies. The spectrum shown in FIG. 3 has a certain power near the main carrier frequency and tapers out at the ends of the frequency spectrum of the transmitter. Spread spectrum transmission presents several advantages over transmission technologies utilizing fixed frequencies. It is relatively immune to interference from other signals, it has a noise-like frequency spectrum footprint reducing the risk of the transmission disturbing other forms of communication, and the individual frequencies used may be transmitted using a lot less power than fixed-frequency systems because the expected frequencies are known in advance.

Figure 4:
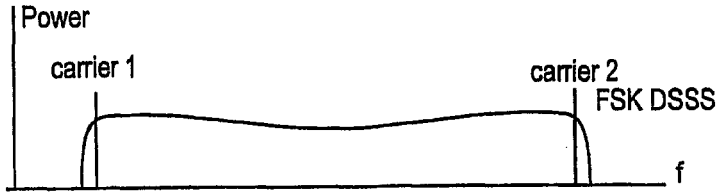
FIG. 4 is a graph showing the frequency spectrum of a spread spectrum (FSK) transceiver.

A more preferred spread spectrum technique is to use frequency shift keying (FSK). It utilizes two carriers for transmission, and it has a frequency spectrum resembling the frequency spectrum shown in FIG. 4. The FSK power spectrum has a more rectangular shape than the spread spectrum technique shown in FIG. 3. The two carrier frequencies, carrier 1 and carrier 2, may be 20 dB lower in power than the carrier of the PM spread spectrum modulation technique shown in FIG. 3, and thus the total bandwidth of the spread spectrum transmitter may be utilized more efficiently and the effective transmission range per Watt may be larger.

In this application, Miller coding is to be understood as a preferred method of encoding serial, digital data such as data for the purpose of wireless transmission. The bit period, i.e. the duration of one bit, "1" or "0", respectively, has to be determined in advance. The information is encoded into the digital bit stream as the spacings between signal transitions without regard to polarity. Allowed spacings between transitions in Miller coding are 1, 1.5, and 2 bit periods. An input of "1" gives a transition at the end of a bit period, i.e. one bit period, an input of "0" gives a transition in the middle of a bit period, i.e. 1.5 bit periods, unless a transition took place at the start of the same bit period, in that case nothing is done, i.e. two bit periods. A "0" following a "1" thus never produces a transition during a bit period. A history of the last bit received is used in the decoding, and thus the last bit received is stored in a convenient manner.

Decoding starts upon reception of a two bit period spacing corresponding to the bit combination "01". A one bit period spacing corresponds to the bit "0" if the last bit was "0", and the bit "1" if the last bit was "1". A 1.5 bit period corresponds to "1" if the last bit was "0", and the bit combination "00" if the last bit was "1".

Figure 5:
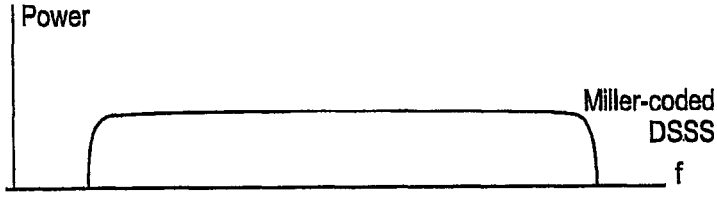
FIG. 5 is a graph showing the frequency spectrum of a squared Miller-coded direct sequence spread spectrum transceiver (FSK-DSSS) according to the invention.

An even more preferred transmission technique is to use Miller-coding together with FSK direct sequence spread spectrum (FSK-DSSS), and its frequency spectrum is shown in FIG. 5. Such a modulation scheme does not utilize a carrier frequency as such, but is primarily defined by its bandwidth and its code sequence. The advantages of the Miller-coded FSK-DSSS technique are the same as those mentioned for FSK-DSSS, but Miller-coded FSK-DSSS transmission is even more efficient. Thus it constitutes an almost ideal choice for a digital transmission system where low power consumption, immunity to noise and interference, and long range per Watt are essential requirements.

Figure 6:
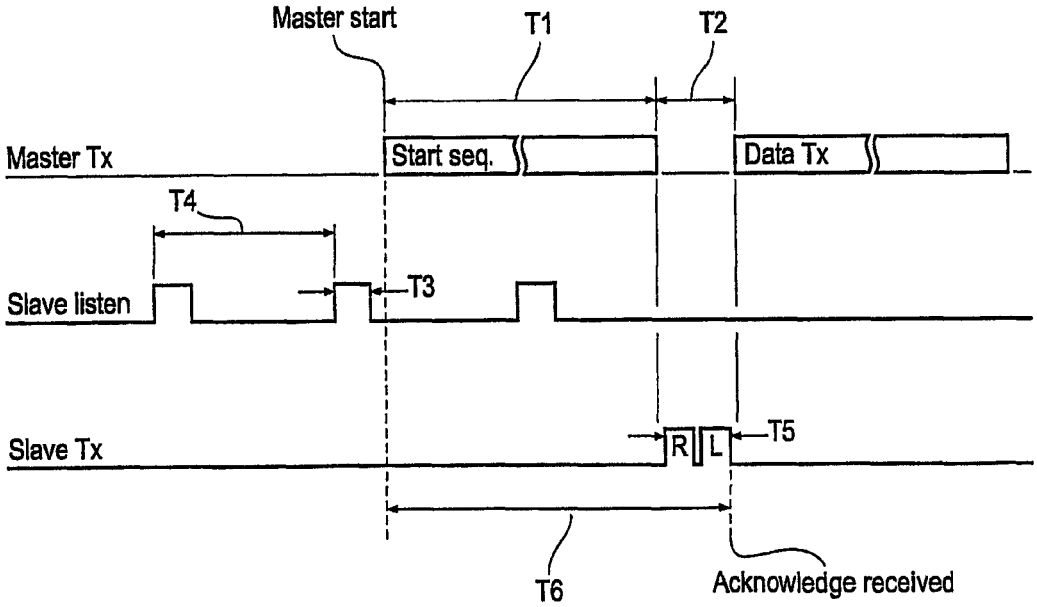
FIG. 6 is a timing diagram showing the communication between a master and a slave transceiver.

FIG. 6 is a timing diagram showing the relative timings involved during a communication between a master transceiver and one or two slave transceivers. Three timelines show the master transmission timing denoted Master Tx, slave listening timing denoted Slave listen, and slave transmission timing denoted Slave Tx. The timings are denoted T1: master transmission period, T2: timing gap period between two independent master transmissions, allowing the master to listen for signals from the slave, T3: slave wakeup and listening period, T4: the time period elapsed between the starting times of two consecutive slave listening periods, T5: the slave transmission period, and T6: the time elapsed between the start of a master transmitting and the end of the slave transmitting an acknowledge signal.

Note that T5 is divided into two parts, denoted R and L, respectively, each allowing a transmission from a respective slave unit. This is a way of allowing the slave units in both a right hearing aid and a left hearing aid sufficient time to respond to the messages from the master. In practice, this is done by adding a delay period to the response time of one of the slave units—in this case the left—and making use of that delay period dependent on the reading of a dedicated bit in the hearing aid EPROM memory that codes the hearing aid as a right or a left hearing aid.

Note that T1 may be of variable length according to the type of message sent. T2 is always greater than T5 in order to allow for the master to receive and decode an acknowledge from both of the slaves. T4 minus T3 is equal to the "hibernate" period when the transceiver in the slave is deactivated, and is always smaller than T6 in order to ensure that a listening period in the slave overlaps a full transmission period from the master.

When a transmission from the master is initiated, it sends out a series of start sequences at regular intervals for the duration of the period T1. The master then pauses for the duration of T2 in order to be able to receive a response from a slave. The slaves listen at regular intervals T3 initiated periodically at intervals T4. Whenever a slave recognizes part of a start sequence from a master when listening, the slave prepares to decode the start sequence in order to verify that it is in fact the particular unit addressed by the master. If this is the case, the slave prepares an acknowledge response and waits until the end of T1 before it transmits the acknowledge response during T5. The master receives and decodes the acknowledge response sent by the slave during T2, and, if the slave transmission is approved, the master transmits data to the slave.

The start sequence is usually only used initially to establish communication between a master and a slave for the first time or in case communication is lost due to a transmission error. In case of a first time communication between a master and a slave, unique identification tags, device status, and the like, are exchanged in order for the master and slave to be able to recognize each other more easily and securely during subsequent transmissions. In cases where two hearing aids are employed for binaural alleviation of a hearing loss, the master transmits a start sequence to be picked up by both the left and the right hearing aid.

During manufacture, each hearing aid is equipped with a bit indicating if it is intended for use in a right ear or a left ear. A hearing aid for the right ear has its slave transmitter set up as described earlier, but a hearing aid for the left ear, on the other hand, has its transmitter set up to await the expiry of a built-in delay equivalent to the duration of a transmission from a slave, before transmitting, in order to avoid transmission collisions with the acknowledge transmission from the hearing aid for the right ear.

Figure 7:
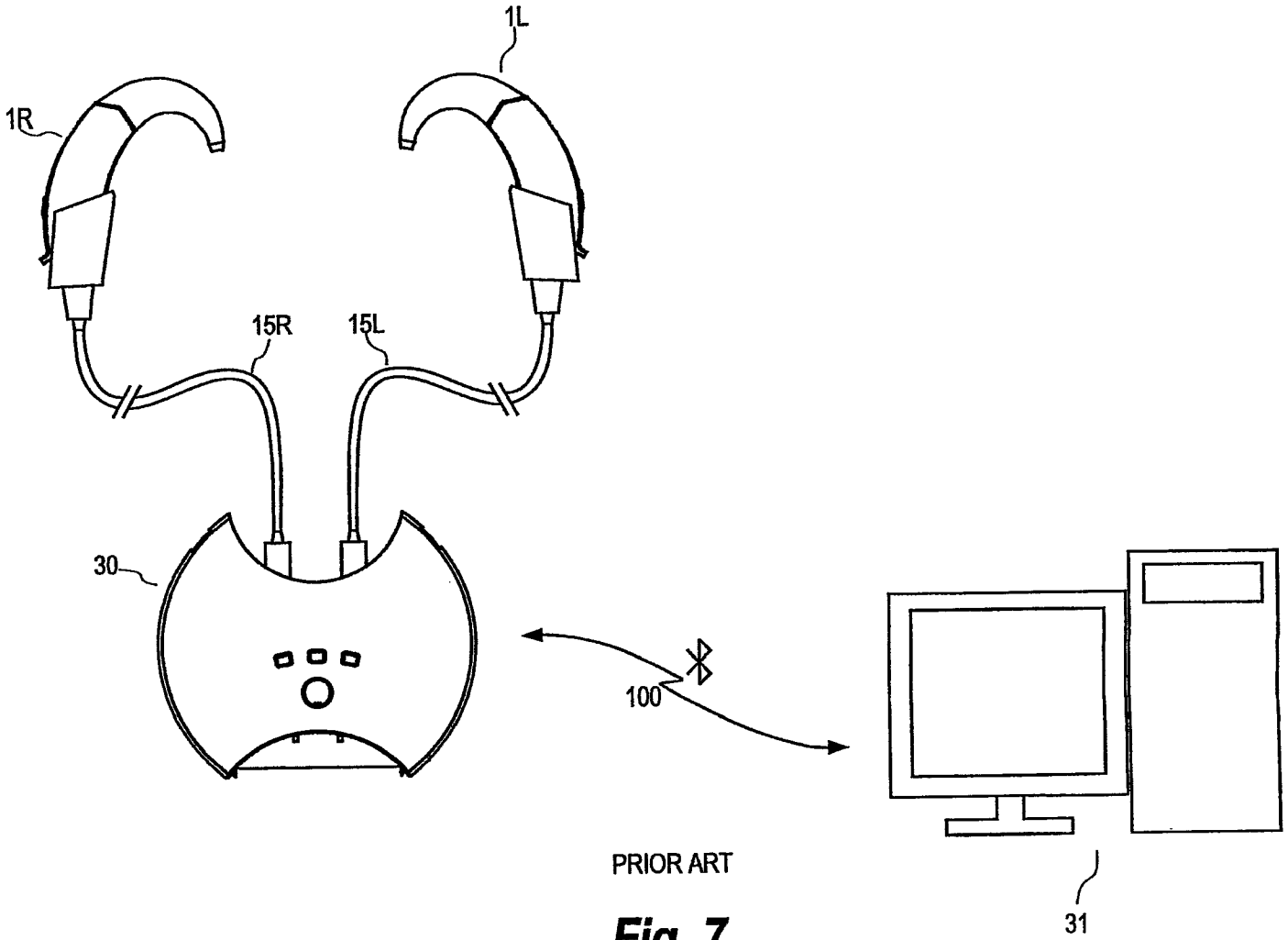
PRIOR ART Fig. 7
FIG. 7 is a prior art hearing aid system with a wireless programming device used in conjunction with two hearing aids and a computer.

A prior art hearing aid system is shown in FIG. 7, where a programming device 30 is connected to two hearing aids 1R and 1L via cables 15R and 15L. The programming device 30 is communicating wirelessly with a computer 31 through a wireless communications channel 100 for the purpose of programming the hearing aids with prescribed frequency responses, respectively, in order to alleviate a user's hearing loss.

During use, the hearing aids 1R and 1L are connected to the programming device 30 via the cables 15R and 15L. The programming device 30 communicates with the computer 31 via the communications channel 100 in order to convey programming information to the hearing aids 1R, 1L. The programming device 30 may receive information regarding the programming from the hearing aids 1R, 1L via the communications channel 100, for instance the locations of the various hearing programmes available to the user, initial sound levels for the individual programs, use of telecoil etc.

Figure 8:
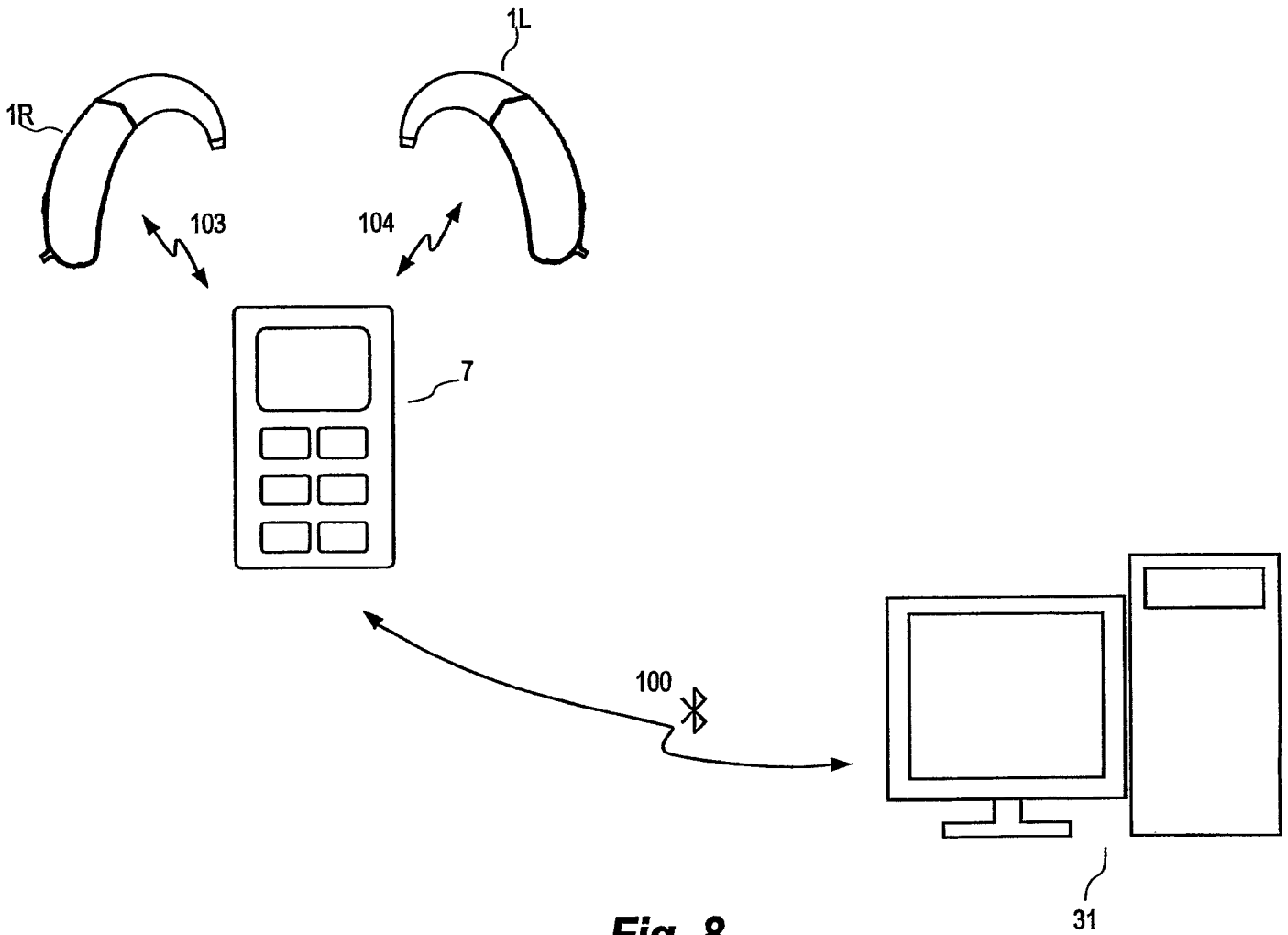
FIG. 8 is a preferred embodiment with a portable module used as a link device between two hearing aids and a computer.

FIG. 8 shows an embodiment of the hearing aid system of the invention, comprising a portable module 7 having a transceiver (not shown), a computer 31, and a right and a left hearing aid 1R and 1L also having transceivers (not shown). The portable module 7 communicates with the computer 31, running hearing aid fitting software, via a first communications link 100, and with hearing aids 1R and 1L via a second and a third communications link 103 and 104, respectively. All three communications links 100, 103, 104, are bidirectional, wireless communications links.

During fitting of one hearing aid or a pair of hearing aids, the fitter prepares a prescriptional fitting with the aid of the hearing aid fitting software running on the computer 31. The prescriptional fitting data are transmitted to the portable module 7 via the first communications link 100. The portable module 7 transmits the received prescriptional fitting data to the hearing aids 1R and 1L via the second and third communications links 103 and 104, respectively. This preferred embodiment of the hearing aid system of the invention leaves out the wireless programming device 30 of the prior art entirely, having the functionality required for programming the hearing aids 1R, 1L built into the portable module 7. This preferred embodiment of the invention enables programming a prescriptional fitting into one or a pair of hearing aids without the need for any electrical wires or connectors connected between the hearing aids and the programming device.

A suitable transmission frequency for the hearing aid system according to the invention is about 12 MHz. The bandwidth of the signal makes it possible to execute transmissions with a data rate of up to around 100 kbit/s upstream and 10 kbit/s downstream, thus rendering the system capable of real-time transmission of (compressed) audio signals upstream or continuously variable parameters upstream or downstream. Direct communication between the hearing aids is also possible at a bit rate of up to 100 kbit/s.

The DSSS coded signals possess an inherently high immunity to noise and interference, and if e.g. eight different spreading codes are used for the DSSS, up to eight similar systems may be used simultaneously within the reliable range of the system of about 1 m. Alternative embodiments may also utilize other frequency bands for transmission, enabling larger bandwidths and thus higher data throughput rates to be used.

I claim:

1. A hearing aid system comprising a portable module, said portable module having a portable module transceiver for transmitting and receiving electromagnetic signals, said portable module transceiver comprising a first Miller encoder for generating data for transmission, a first Miller decoder for decoding received signals and means for producing output data based on the decoded signals, said hearing aid system comprising at least one hearing aid having a hearing aid transceiver for transmitting and receiving electromagnetic signals, said hearing aid transceiver comprising a second Miller decoder for decoding received signals, means for storing programming information derived from the decoded signals, means for producing an output signal based on the decoded signals, and a second Miller encoder for generating data for transmission, the portable module transceiver and the hearing aid transceiver being adapted for transmitting and receiving Miller-encoded signals modulated according to a direct sequence spread spectrum (DSSS) scheme.

2. The system according to claim 1, wherein the portable module transceiver comprises a first modulator having means for producing binary phase-shift keying (BPSK)-modulated signals.

3. The system according to claim 1, wherein the portable module transceiver comprises a second modulator having means for producing frequency shift keying (FSK)-modulated signals.

4. The system according to claim 1, wherein the portable module transceiver comprises a first demodulator having means for demodulating BPSK-modulated signals.

5. The system according to claim 1, wherein the portable module transceiver comprises a second demodulator having means for demodulating FSK-modulated signals.

6. The system according to claim 1, wherein the portable module transceiver comprises a master section comprising an output stage, a frequency reference crystal, and an oscillator controlled by said frequency reference crystal, said master section being electrically detachable from the transceiver circuitry.

7. The system according to claim 1, wherein the hearing aid transceiver comprises a slave section having an oscillator controlled by an externally derived clock source.

8. The system according to claim 1, wherein the hearing aid transceiver comprises a receiver for receiving electromagnetic signals modulated according to said DSSS scheme, said second Miller decoder for decoding the received signals and for producing output data based on the decoded signals, and mode selection means for selectively activating the receiver or the transmitter of the hearing aid transceiver.

9. The system according to claim 1, wherein the portable module comprises an input for data, and the portable module transceiver comprises a transmitter for transmitting electromagnetic signals based on the input data and modulated according to said DSSS scheme, and mode selection means for selectively activating the receiver or the transmitter of the portable module transceiver.

10. The system according to claim 1, wherein the portable module transceiver comprises a first phase-locked loop common to the transmitter and the receiver of the portable module transceiver.

11. The system according to claim 1, wherein the hearing aid transceiver comprises a second phase-locked loop common to the transmitter and the receiver of the hearing aid transceiver.

12. The system according to claim 1, wherein the portable module comprises a telecoil adapted for picking up a telecoil signal and means for connecting the telecoil to the portable module transceiver.

13. The system according to claim 1, wherein the portable module comprises a microphone adapted for picking up a microphone signal and means for connecting the microphone to the portable module transceiver.

14. The system according to claim 1, wherein the portable module comprises a wireless interface adapted for receiving a wireless signal and means for connecting said wireless interface to the portable module transceiver.

15. The system according to claim 1, comprising a computer having an interface for communication with the portable module.

16. The system according to claim 1, wherein the system comprises a first hearing aid (1R) and a second hearing aid (1L), and wherein the transceiver of the first hearing aid (1R) and the transceiver of the second hearing aid (1L) are adapted for coordinating their respective transmissions in order to avoid transmission collisions.

17. A method of operating a hearing aid system, comprising the steps of:

a. selecting a hearing aid having input means for receiving Miller encoded input data;

b. receiving Miller encoded input data in the hearing aid;

c. Miller decoding the input data;

d. Miller encoding output data for transmission, e. transmitting from the hearing aid electromagnetic signals based on the output data and modulated according to a DSSS scheme;

f. receiving the electromagnetic signals modulated according to a DSSS scheme in a portable module;

g. demodulating and Miller decoding the electromagnetic signals, and;

h. producing output data in the portable module based on the Miller decoded signals.

18. The method according to claim 17, wherein the output data transmitted from the hearing aid is an acknowledge signal.

19. The method according to claim 18, wherein the acknowledge signal is transmitted within a predetermined period after decoding the received signals.

20. A method of programming a hearing aid, said method comprising the steps of:

a. determining a hearing loss to be compensated by a hearing aid;

b. selecting a hearing aid adapted for compensating a hearing loss according to program settings stored in the hearing aid and for receiving and transmitting electromagnetic signals modulated according to a DSSS scheme wherein said electromagnetic signals are Miller-encoded signals;

c. using a computer to generate program settings for the hearing aid suitable for compensating the hearing loss;

d. transmitting the program settings from the computer to a portable module;

e. transmitting the program settings from the portable module to the hearing aid by electromagnetic transmission of Miller-encoded signals modulated according to a DSSS scheme;

f. receiving the electromagnetic transmission in the hearing aid;

g. decoding and storing the received program settings in the hearing aid;

h. transmitting from the hearing aid electromagnetic signals based on data from the hearing aid modulated according to a DSSS scheme wherein said electromagnetic signals are Miller-encoded signals;

i. receiving and decoding in the portable module electromagnetic Miller-encoded signals modulated according to a DSSS scheme in order to produce a decoded output; and j. transmitting data based on the decoded output from the portable module to the computer.

21. The method according to claim 20, wherein the data from the hearing aid represent audio signals picked up by the hearing aid.

* * * * *